US009065173B2

(12) United States Patent
Brossier et al.

(10) Patent No.: US 9,065,173 B2
(45) Date of Patent: Jun. 23, 2015

(54) MULTIPLE-REFLECTOR ANTENNA FOR TELECOMMUNICATIONS SATELLITES

(71) Applicants: THALES, Neuilly-sur-Seine (FR); CENTRE NATIONAL D'ETUDE SPATIALES (CNES), Paris (FR)

(72) Inventors: Jerome Brossier, Fonsorbes (FR); Ludovic Schreider, Toulouse (FR); Serge Depeyre, Blagnac (FR); Laurent Cadiergues, Toulouse (FR)

(73) Assignees: THALES, Courbevoie (FR); CENTRE NATIONAL D'ETUDE SPATIALES (CNES), Paris (FR)

( * ) Notice: Subject to any disclaimer, the term of this patent is extended or adjusted under 35 U.S.C. 154(b) by 305 days.

(21) Appl. No.: 13/862,095

(22) Filed: Apr. 12, 2013

(65) Prior Publication Data

US 2013/0271332 A1 Oct. 17, 2013

(30) Foreign Application Priority Data

Apr. 13, 2012 (FR) ..... 12 01099

(51) Int. Cl.
*H01Q 3/12* (2006.01)
*H01Q 3/20* (2006.01)
*H01Q 19/10* (2006.01)

(52) U.S. Cl.
CPC . *H01Q 3/20* (2013.01); *H01Q 19/10* (2013.01)

(58) Field of Classification Search
CPC ..... H01Q 3/12
USPC ..... 343/761, 757–759, 781 P, 781 CA
See application file for complete search history.

(56) References Cited

U.S. PATENT DOCUMENTS

| | | | | |
|---|---|---|---|---|
| 4,408,209 | A * | 10/1983 | Urien et al. | 343/861 |
| 5,526,008 | A | 6/1996 | Meserole et al. | |
| 6,239,763 | B1 | 5/2001 | Cuchanski | |
| 7,129,901 | B2 * | 10/2006 | Tietjen | 343/757 |
| 7,199,764 | B2 * | 4/2007 | Tietjen et al. | 343/757 |
| 2007/0052607 | A1 * | 3/2007 | Dwornik et al. | 343/766 |
| 2008/0291102 | A1 * | 11/2008 | Yun et al. | 343/761 |

* cited by examiner

*Primary Examiner* — Huedung Mancuso
(74) *Attorney, Agent, or Firm* — Baker & Hostetler LLP

(57) ABSTRACT

A multiple-reflector antenna for telecommunications satellites including a shaft, to which are attached at least two sub-reflectors, rotating in relation to a load-bearing structure, and a motor including a rotor able to drive the shaft in rotation, and a stator attached to the load-bearing structure, wherein the multiple-reflector antenna also includes two bearings enabling the shaft to rotate in relation to the load-bearing structure, a torsionally rigid mechanical filter placed between the shaft and the rotor, enabling the rotor to transmit the rotational movement to the shaft, and able to dampen the stresses generated by the shaft on the motor, and locking means able to hold the angular position of the shaft in relation to the load-bearing structure.

12 Claims, 4 Drawing Sheets

MULTIPLE-REFLECTOR ANTENNA FOR TELECOMMUNICATIONS SATELLITES

CROSS-REFERENCE TO RELATED APPLICATION

Figure 1:
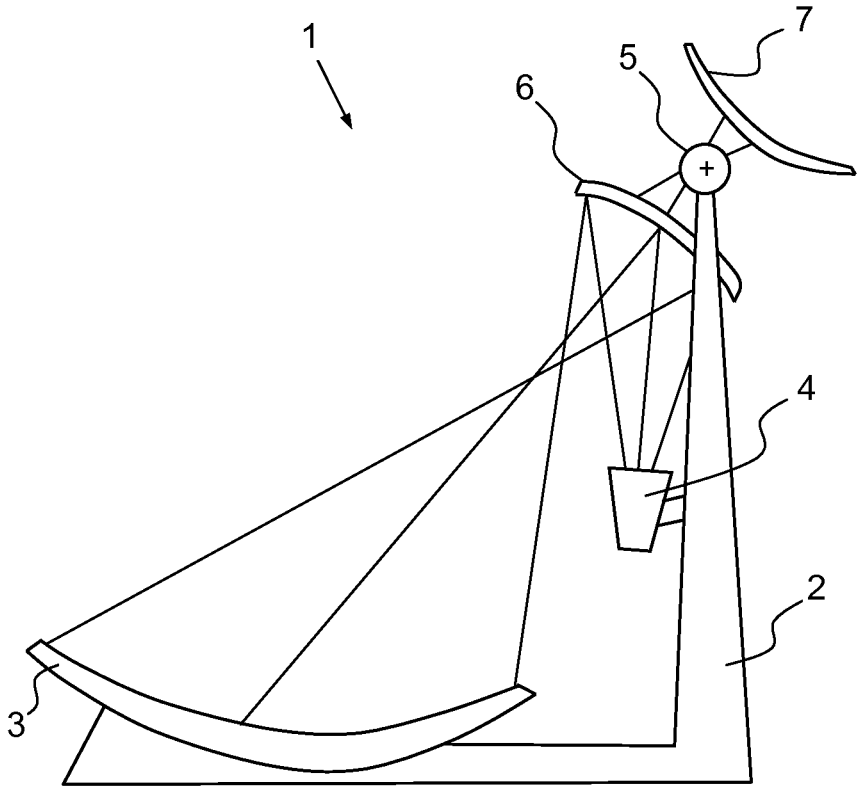

This application claims priority to foreign French patent application No. FR 1201099, filed on Apr. 13, 2012, the disclosure of which is incorporated by reference in its entirety.

FIELD OF THE INVENTION

The present invention relates to a multiple-reflector antenna for radio-frequency telecommunications satellites, and in particular a device for switching between several sub-reflectors intended to reflect a wave beam between a feed and a main reflector, such as a Gregorian antenna on board a geostationary-orbit satellite platform.

BACKGROUND

The increasing service life of telecommunication satellites and the changing requirements related to different missions have resulted in the development of new generations of satellites intended to improve mission flexibility. This is notably the case for telecommunications antennas and the mechanisms related thereto, for which designers aim for example to provide the option of choosing between several coverage zones and several frequency planes, and thus to give the option of changing satellite missions once they are in orbit.

There are several approaches to improving the mission flexibility of telecommunications satellite antennas. A first approach uses an active antenna known as a computational beamforming antenna. To improve mission flexibility, these antennas make it possible to target an extended geographical area by moving the beam. However, these antennas require a complex and costly electronic module. Indeed, this electronic module requires for example the integration of numerous processors to determine the orientation of the beam, radiating elements to form the beam, energy supply equipment to power the processors and high-performance heat-dissipation equipment. Inclusion of all of these elements significantly increases the cost of designing and launching a satellite fitted therewith into space.

A second approach uses a device for switching between several sub-reflectors mounted on a shaft. Rotating this shaft in relation to the frame of the antenna structure, to which a main reflector and a feed are rigidly connected, makes it possible to target several coverage zones on the Earth.

In a known implementation, the axis of rotation of the shaft bearing the sub-reflectors is contained within a plane, commonly referred to as a focal plane, including the centre of the main reflector, the centre of the sub-reflector and the feed. So as not to interfere with the field scanned by the wave beam of the antenna, the shaft bearing the sub-reflectors needs to be connected to the frame of the mechanical structure from behind the antenna, creating a large cantilever. This support from the rear requires a mechanical structure that is very inflexible, voluminous and heavy to enable it to withstand the stresses applied to the satellite platform during launch from a spacecraft.

More generally, the issue of stowing, enabling all of the equipment to be kept in place during a launch phase, and unstowing, enabling the equipment to be released and made operational, is key. The solutions currently available for switching between several reflectors do not address this issue efficiently.

SUMMARY OF THE INVENTION

The present invention is intended to propose an alternative to a device for switching antenna reflectors by resolving the implementation difficulties mentioned above.

For this purpose, the invention concerns a multiple-reflector antenna for telecommunications satellites comprising a shaft, to which are attached at least two sub-reflectors, rotating in relation to a load-bearing structure, and a motor including a rotor able to drive the shaft in rotation, and a stator attached to the load-bearing structure, characterized in that the multiple-reflector antenna also includes:

- two bearings enabling the shaft to rotate in relation to the load-bearing structure, the sub-reflectors being attached to the shaft between the two bearings,
- a torsionally rigid mechanical filter, placed between the shaft and the rotor, enabling the rotor to transmit the rotational movement to the shaft, and able to dampen the stresses generated by the shaft on the motor,
- locking means able to hold the angular position of the shaft in relation to the load-bearing structure, in a first stored arrangement referred to as "stowed", and to use the motor to release the shaft to enable it to rotate, in an operational arrangement referred to as "unstowed".

BRIEF DESCRIPTION OF THE ACCOMPANYING DRAWINGS

Figure 2A:
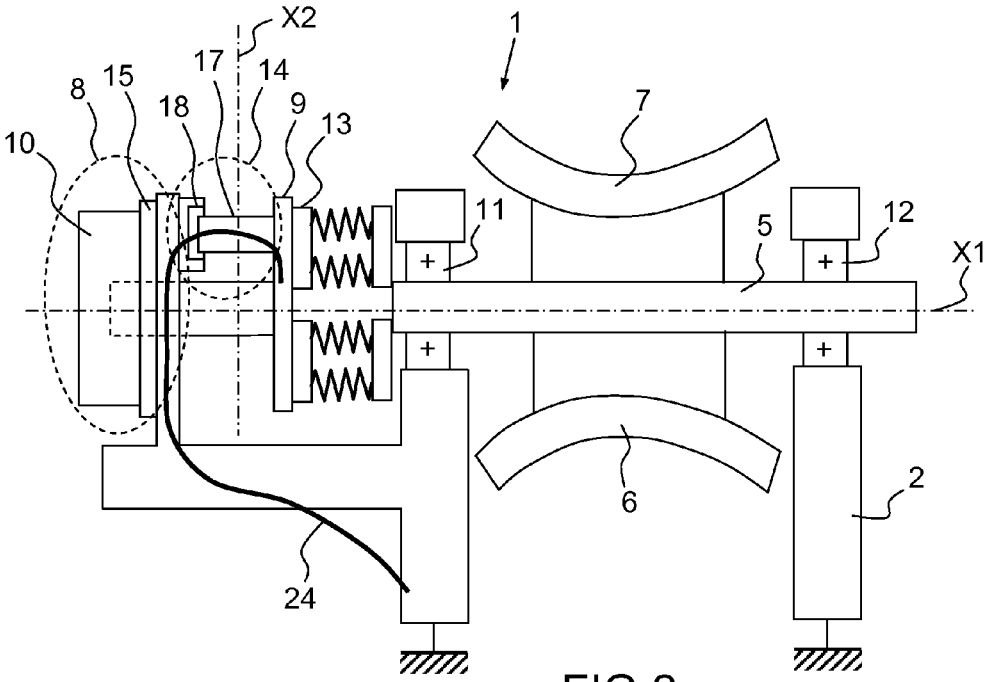
Figure 2B:
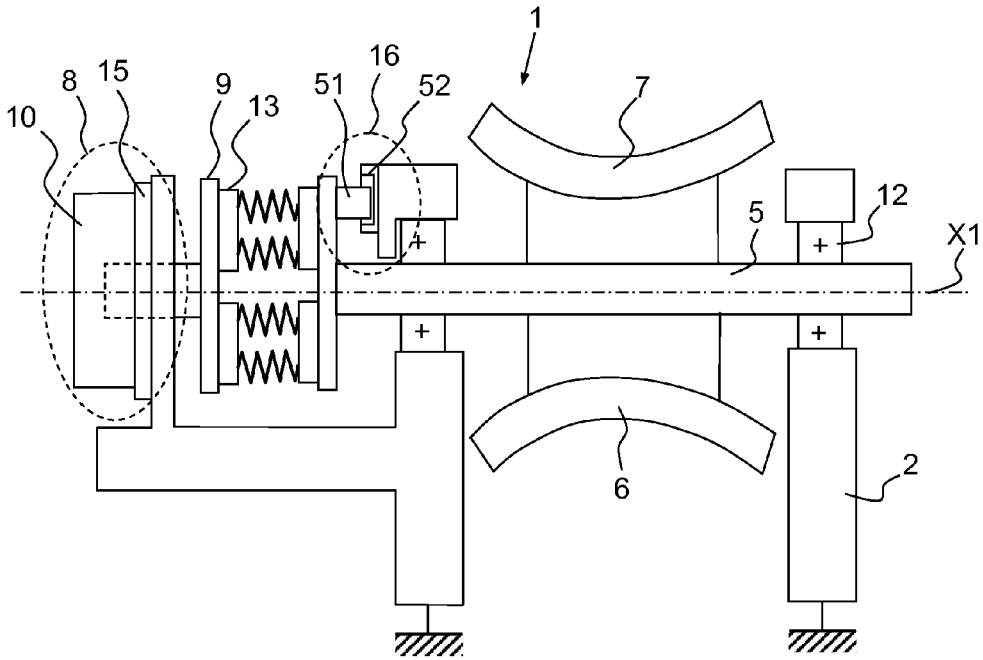
Figure 3A:
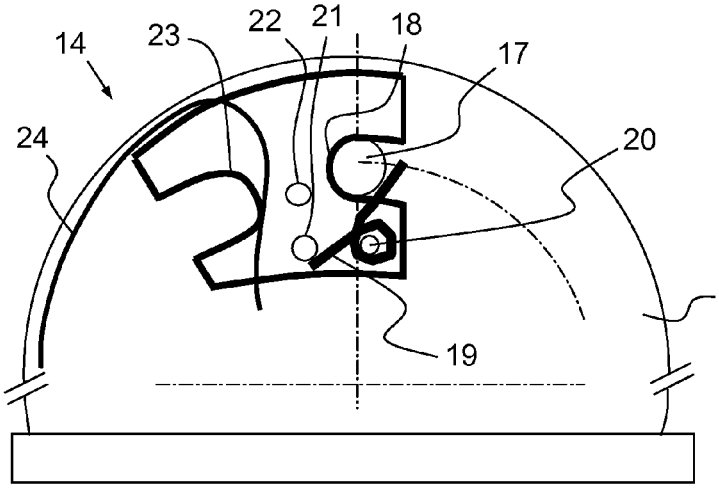
Figure 3B:
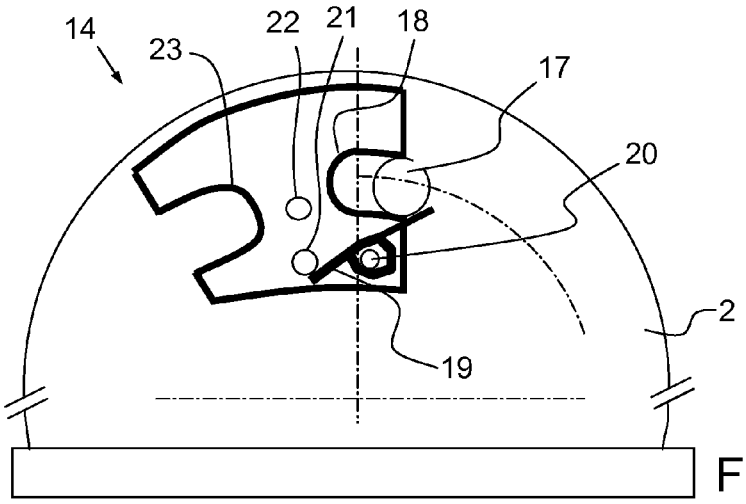
Figure 3C:
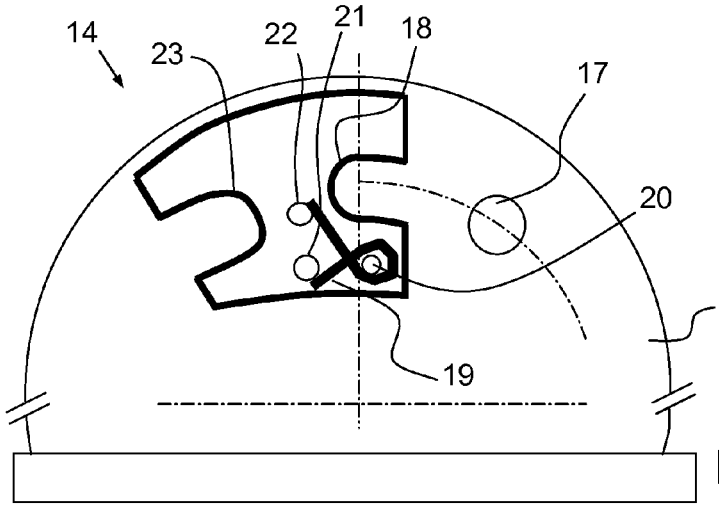
Figure 4:
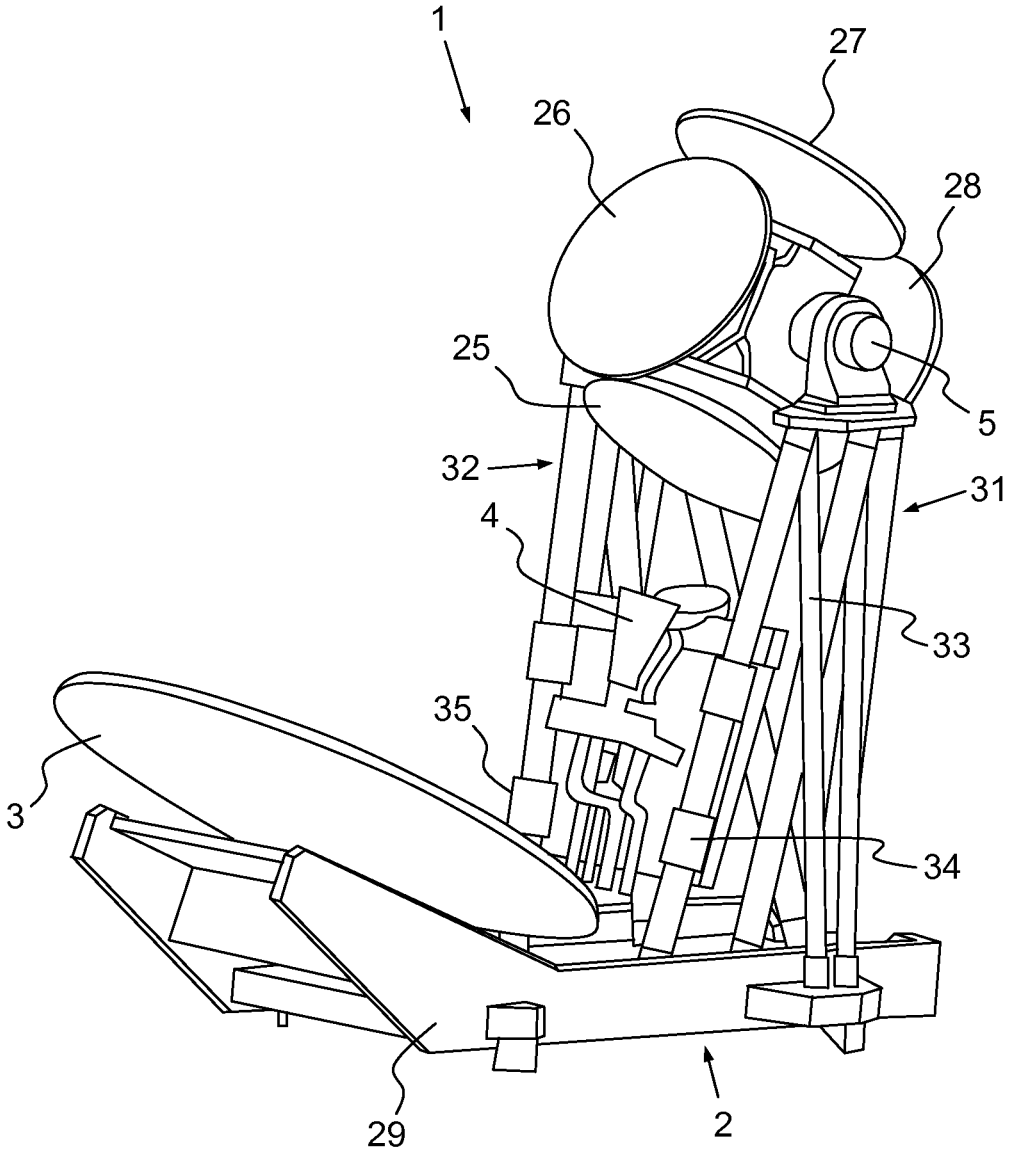

The invention will be better understood and other advantages will become apparent by reading the detailed description of the embodiments given by way of example in the following figures:

FIG. 1 is a schematic drawing of a multiple-reflector antenna according to the invention fitted with a main reflector, a feed and two sub-reflectors that can be switched by rotation, FIGS. 2*a* and 2*b* show two embodiments of a system for switching between several sub-reflectors of an antenna as described in FIG. 1, FIGS. 3*a*, 3*b* and 3*c* show means for locking the switching system described in FIG. 2*a* in the stowed position (3*a*), the unstowed position (3*b*) and an intermediate position (3*b*), FIG. 4 is a view of a multiple-reflector antenna according to the two embodiments of the invention.

For the sake of clarity, the same elements are marked with the same reference signs in all of the figures.

DETAILED DESCRIPTION

FIG. 1 is a schematic drawing of a multiple-reflector antenna 1 comprising a load-bearing structure 2 to which a main reflector 3 and a feed 4 are attached. The multiple-reflector antenna 1 also includes a shaft 5, to which are attached two sub-reflectors 6 and 7, rotating in relation to a load-bearing structure 2.

It is understood that the invention may be implemented for an antenna with no main reflector. The sub-reflectors 6 and 7 then become reflectors able to directly reflect a wave beam between the feed 4 and a coverage zone.

In FIG. 1, the sub-reflector 6 is in the operational position in which it can reflect a wave beam between the feed 4 and the main reflector 3. The plane containing the emission point of the feed 4, the centre of the sub-reflector 6 and the centre of the main reflector 3 is hereinafter referred to as the focal plane of the antenna 1.

In FIG. 1, the multiple-reflector antenna 1 used is a Gregorian antenna. The sub-reflectors 6 and 7 are substantially ellipsoidal and are mounted on the shaft 5 such that the concave surface thereof reflects the wave beam between the main reflector 3 and the feed 4.

In an alternative arrangement of the present invention, a Cassegrain multiple-reflector antenna 1 is used. One or more substantially parabolic sub-reflectors are mounted on the shaft 5 such that the convex surface thereof reflects the wave beam between the main reflector 3 and the feed 4.

It is also possible to attach to the shaft 5 a sub-reflector 6 such that the concave surface thereof reflects the wave beam, and a reflector 7 such that the convex surface thereof reflects the wave beam, thereby further enhancing the mission flexibility of the antenna.

FIG. 2*a* shows a first embodiment of a system for switching between several sub-reflectors of an antenna as described in FIG. 1.

The multiple-reflector antenna 1 includes the shaft 5, to which are attached the two sub-reflectors 6 and 7, rotating in relation to the load-bearing structure 2, and a motor 8 including a rotor 9 able to drive the shaft 5 in rotation, and a stator 10 attached to the load-bearing structure 2. The shaft 5 can rotate in relation to the load-bearing structure 2 about an axis of rotation X1 perpendicular to the focal plane of the antenna.

The multiple-reflector antenna 1 also includes:

- two bearings 11 and 12 enabling the shaft 5 to rotate in relation to the load-bearing structure 2, the sub-reflectors 6 and 7 being attached to the shaft 5 between the two bearings 11 and 12,
- a torsionally rigid mechanical filter 13, placed between the shaft 5 and the rotor 9, enabling the rotor 9 to transmit the rotational movement to the shaft 5, that is able to absorb the alignment errors between the rotor 9 and the shaft 5, and able to dampen the stresses generated by the shaft 5 on the motor 8,
- locking means 14 able to hold the angular position of the shaft 5 in relation to the load-bearing structure 2, in a first stored arrangement referred to as "stowed", and to use the motor 8 to release the shaft 5 to enable it to rotate, in an operational arrangement referred to as "unstowed".

This implementation is particularly advantageous because the portal structure, formed by the two bearings 11 and 12 placed on either side of the sub-reflectors 6 and 7, helps to significantly reduce the cantilever stresses generated, notably during a launching phase of the satellite. This is not the case with known solutions implementing switching devices in which the axis of rotation X1 of the shaft 5 is in the focal plane of the antenna, in which all of the movable elements are borne on a single extremity so as not to interfere with the field scanned by the wave beam of the antenna.

Advantageously, the two bearings 11 and 12 are mechanical rotational bearings.

Advantageously, the mechanical filter 13 is a torsionally rigid metal bellows able to absorb the stresses generated by the shaft 5 on the motor 10, and notably the translational and shear stresses as well as the bending moments generated during a launch phase of the satellite.

Advantageously, the mechanical filter 13 also enables any alignment errors between the axis of rotation X1 of the shaft 5 and the axis of rotation of the motor 8 to be offset.

Advantageously, the motor 8 includes a radiator 15 able to radiate heat produced by the motor 8 when it is running, and able to heat the motor 8.

Advantageously, the function of the radiator 15 used to heat the motor 8 is electrical.

Advantageously, the locking means 14 include a catch 17 rigidly connected to the rotor 9 and a slot 18 rigidly connected to the load-bearing structure 2. This first embodiment is particularly advantageous because it enables the motor 8 to be effectively protected against the torsional stresses between the rotor 9 and the stator 10 and prevents any untimely rotational movement of the rotating part during the launch phase of the satellite. The locking means 14 are shown in FIGS. 3*a*, 3*b* and 3*c* as cross sections along an axis X2 perpendicular to the axis X1 and passing through the rotor 9, as shown in FIG. 2*a*.

FIG. 2*b* shows a second embodiment of a system for switching between several sub-reflectors of an antenna as described in FIG. 1.

The multiple-reflector antenna 1 includes the shaft 5, to which are attached the two sub-reflectors 6 and 7, rotating in relation to the load-bearing structure 2, and the motor 8 including the rotor 9 able to drive the shaft 5 in rotation, and the stator 10 attached to the load-bearing structure 2. The shaft 5 can rotate in relation to the load-bearing structure 2 about an axis of rotation X1 perpendicular to the focal plane of the antenna.

Advantageously, the multiple-reflector antenna 1 also includes:

- the two bearings 11 and 12,
- the mechanical filter 13,
- locking means 16 able to hold the angular position of the shaft 5 in relation to the load-bearing structure 2, in a first stored arrangement referred to as "stowed", and to use the motor 8 to release the shaft 5 to enable it to rotate, in an operational arrangement referred to as "unstowed".

Advantageously, the locking means 16 include a catch 51 rigidly connected to the shaft 5 and a slot 52 rigidly connected to the load-bearing structure 2. This second embodiment is particularly advantageous because it enables the shaft 5 to be fixed in rotation in relation to the load-bearing structure 2, thereby protecting the motor 8 and the mechanical filter 13 from the torsional stresses generated by the shaft and the components connected thereto.

FIGS. 3*a*, 3*b* and 3*c* show the locking means 14 in the stowed position (3*a*), the unstowed position (3*c*) and an intermediate position (3*b*), as cross sections along the axis X2 described in FIG. 2*a*.

Advantageously, the locking means 14 include the catch 17 rigidly connected to the rotor 9, the slot 18 rigidly connected to the load-bearing structure 2, and a torsion spring 19 enabling the catch 17 to be held against the bottom of the slot 18 in the stowed arrangement; the torsion spring 19 being switched to an idle position, in the unstowed arrangement, by the motor 8, enabling the rotor 9 to rotate.

In FIG. 3*a*, the torsion spring 19 holds the catch 17 against the bottom of the slot 18. The torsion spring 19 is tensioned between the catch 17 and two holding studs 20 and 21 rigidly connected to the load-bearing structure 2.

In FIG. 3*b*, the motor 8 is able to produce enough force to move the catch 17 out of the slot 18 and to release it from the torsion spring 19.

In FIG. 3*c*, the catch 17 is released from the slot 18 and from the torsion spring 19. The rotor 9 is free to rotate. Advantageously, the torsion spring 19 is held in idle position, in the unstowed arrangement, between the two holding studs 20 and 21 and a third idle stud 22 rigidly connected to the load-bearing structure 2.

Advantageously, the torsion spring 19 is tensioned, in the stowed arrangement, between the catch 17 and the two holding studs 20 and 21, rigidly connected to the load-bearing structure 2, and is held in idle position, in the unstowed arrangement, between the two holding studs 20 and 21 and the third idle stud 22, rigidly connected to the load-bearing structure 2.

Advantageously, the force generated by the torsion spring 19 on the catch 17 in the stowed arrangement is enough to counter the torsional stresses transmitted by the shaft 5 and the components attached thereto to the motor 8, notably during a launch phase of the satellite.

Advantageously, the torsion spring 19 is a metal blade that opposes a maximum torsional force that can be adjusted by means of a manual deformation operation prior to assembly in the stowed arrangement.

This locking means is particularly advantageous because it is simple, easily reconfigurable, and much cheaper than known stowing devices, notably those based on electro-pyrotechnical components. It is notably possible to repeatedly reset the torsion spring 19 in the stowed position to enable the locking means 14 to be tested and fine-tuned before a launch phase.

Advantageously, the torsion spring 19 and the studs 20, 21 and 22 are positioned such as to enable the rotor 9, in the unstowed arrangement, to return to the angular position initially occupied in the stowed arrangement, the catch 17 being mechanically stopped in a first angular position against the bottom of the slot 18.

Advantageously, a second slot 23 rigidly connected to the load-bearing structure 2 enables the catch 17 to be mechanically stopped in a second angular position.

Advantageously, the mechanical stops arranged between the shaft 5 and the load-bearing structure 2, for example between the catch 17 and the slots 18 and 23, make it possible to limit the amplitude of rotation of the shaft 5, and enable an electrical cable 24 to pass between the load-bearing structure 2 and the shaft 5.

Advantageously, the electrical cable 24 includes means for earthing the equipment mounted on the shaft 5, and means for powering a temperature measurement device mounted on the shaft 5.

Operation of the locking means 16 is similar to operation of the locking means 14, as shown in FIGS. 3*a*, 3*b* and 3*c*. Advantageously, the locking means 16 include the catch 51 rigidly connected to the shaft 5, the slot 52 rigidly connected to the load-bearing structure 2, and the torsion spring 19 enabling the catch 51 to be held against the bottom of the slot 52 in the stowed arrangement; the torsion spring 19 being switched to an idle position, in the unstowed arrangement, by the motor 8, enabling the shaft 5 to rotate.

FIG. 4 is a perspective view of the multiple-reflector antenna 1 according to the two embodiments of the invention. The multiple-reflector antenna 1 includes a load-bearing structure 2 to which a main reflector 3, a feed 4 and a shaft 5 are attached. Four sub-reflectors 25, 26, 27 and 28 are attached to the shaft 5.

Advantageously, the load-bearing structure 2 includes two lifting structures 31 and 32 each formed by a plurality of lifting bars 33; each of the lifting structures 31 and 32 being attached on one side to the frame 28 of the load-bearing structure 2 and on the other side to one of the bearings 8 and 9.

Advantageously, the feed 4 is rigidly connected to the load-bearing structure 2 by means of two attachments 34 and 35 on the lifting structures 31 and 32.

Advantageously, each of the lifting bars 33 is made of a carbon-fibre-based composite material.

This implementation is particularly advantageous because the load-bearing structure 2 assembled in this way is neither flexible nor bulky, which makes it particularly suited to use in very limited-space environments, notably near to the sub-reflectors and the field scanned by the wave beam.

The invention claimed is:

1. A multiple-reflector antenna for telecommunications satellites including a shaft, to which are attached at least two sub-reflectors, rotating in relation to a load-bearing structure, and a motor including a rotor able to drive the shaft in rotation, and a stator attached to the load-bearing structure, the multiple-reflector antenna further comprising:

two bearings enabling the shaft to rotate in relation to the load-bearing structure, the sub-reflectors being attached to the shaft between the two bearings, a torsionally rigid mechanical filter, placed between the shaft and the rotor, enabling the rotor to transmit the rotational movement to the shaft, that is able to absorb the alignment errors between the rotor and the shaft, and able to dampen the stresses generated by the shaft on the motor, locking means able to hold the angular position of the shaft in relation to the load-bearing structure, in a first stored arrangement being stowed, and to use the motor to release the shaft to enable it to rotate, in an operational arrangement referred to as "unstowed".

2. The multiple-reflector antenna according to claim 1, wherein the locking means include a catch rigidly connected to the rotor, a slot rigidly connected to the load-bearing structure, and a torsion spring enabling the catch to be held against the bottom of the slot in the stowed arrangement; the torsion spring being switched to an idle position, in the unstowed arrangement, by the motor, enabling the rotor to rotate.

3. The multiple-reflector antenna according to claim 1, wherein the locking means include a catch rigidly connected to the shaft, a slot rigidly connected to the load-bearing structure, and a torsion spring enabling the catch to be held against the bottom of the slot in the stowed arrangement; the torsion spring being switched to an idle position, in the unstowed arrangement, by the motor, enabling the shaft to rotate.

4. The multiple-reflector antenna according to claim 2, wherein the torsion spring is tensioned, in the stowed arrangement, between the catch and two holding studs, rigidly connected to the load-bearing structure, and held in idle position, in the unstowed arrangement, between the two holding studs and a third idle stud, rigidly connected to the load-bearing structure.

5. The multiple-reflector antenna according to claim 1, wherein the mechanical filter is a torsionally rigid metal bellows able to absorb the stresses generated by the shaft on the motor, and the translational and shear stresses and the bending moments generated during a launch phase of the satellite.

6. The multiple-reflector antenna according to claim 1, wherein mechanical stops are arranged between the shaft and the load-bearing structure, so as to limit the amplitude of rotation of the shaft, and enable an electrical cable to pass between the load-bearing structure and the shaft.

7. The multiple-reflector antenna according to claim 6, wherein the electrical cable includes means for earthing the equipment mounted on the shaft, and means for powering a temperature measurement device mounted on the shaft.

8. The multiple-reflector antenna according to claim 1, wherein the motor includes a radiator able to radiate heat produced by the motor when it is running, and able to heat the motor.

9. The multiple-reflector antenna according to claim 1, wherein the bearings are mechanical rotational bearings.

10. The multiple-reflector antenna according to claim 1, wherein the load-bearing structure includes two lifting structures each formed by a plurality of lifting bars; each of the lifting structures being attached on one side to the frame of the load-bearing structure and on the other side to one of the bearings.

11. The multiple-reflector antenna according to claim 10, wherein each of the lifting bars is made of a carbon-fibre-based composite material.

12. The multiple-reflector antenna according to claim 1, wherein said at least two reflectors form sub-reflectors, and the multiple-reflector antenna also includes a main reflector and a feed attached to the load-bearing structure, and, in the operational arrangement, one of the sub-reflectors reflects a wave beam between the feed and the main reflector, and the shaft rotates in relation to the load-bearing structure about an axis, and the axis is substantially perpendicular to a focal plane of the antenna containing an emission point of the feed, a centre of the main reflector and a centre of the sub-reflector used.

* * * * *